US010045574B2

(12) United States Patent
Darnell

(10) Patent No.: US 10,045,574 B2
(45) Date of Patent: Aug. 14, 2018

(54) COMBINATION BEACH TOWEL AND COVER-UP

(71) Applicant: Kamillia Darnell, Cumming, GA (US)

(72) Inventor: Kamillia Darnell, Cumming, GA (US)

( * ) Notice: Subject to any disclaimer, the term of this patent is extended or adjusted under 35 U.S.C. 154(b) by 0 days.

(21) Appl. No.: 14/776,727

(22) PCT Filed: Mar. 14, 2014

(86) PCT No.: PCT/US2014/029821

§ 371 (c)(1),
(2) Date: Sep. 14, 2015

(87) PCT Pub. No.: WO2014/153261

PCT Pub. Date: Sep. 25, 2014

(65) Prior Publication Data

US 2016/0029718 A1 Feb. 4, 2016

Related U.S. Application Data

(63) Continuation of application No. 61/780,989, filed on Mar. 14, 2013.

(51) Int. Cl.
*F26B 25/00* (2006.01)
*A41D 15/04* (2006.01)
(Continued)

(52) U.S. Cl.
CPC ..... *A41D 15/04* (2013.01); *A41D 7/008* (2013.01); *A47G 9/062* (2013.01); *A47G 9/064* (2013.01); *A41D 15/00* (2013.01)

(58) Field of Classification Search
CPC ..... F26B 19/00; F26B 23/00; F26B 25/00; A41D 7/00; A41D 15/05
(Continued)

(56) References Cited

U.S. PATENT DOCUMENTS 2,420,344 A * 5/1947 Alexander ..... A47G 9/064 2/69
2,794,985 A * 6/1957 Brennish ..... A45D 44/08 2/48
(Continued)

FOREIGN PATENT DOCUMENTS

FR 2823418 A1 * 10/2002 ..... A01K 13/001
WO WO 2014/153261 * 9/2014

*Primary Examiner* — Stephen M Gravini
(74) *Attorney, Agent, or Firm* — David D. Griner; Randall W. Burton

(57) ABSTRACT

An improved beach towel that can be converted to a swimsuit cover-up by simply wrapping the towel long ways around a wearer's body and buttoning the attached two buttons into the buttonholes that are along one length of the towel. In some embodiments, the inventive beach towel has two buttons attached to a face of the beach towel toward a corner of one end of the towel, and also has a series of evenly spaced buttonholes along the same length of the towel at the other end. The spacing between the two buttons matches a spacing of the buttonholes. This allows the wearer of the beach towel/cover up to wrap the towel around their hips, waist, or chest, and secure the buttons into appropriate buttonholes so that the cover up fits the wearer. The cover up can be easily adjusted for different sizes simply by choosing other buttonholes in the series of button holes.

18 Claims, 6 Drawing Sheets

(51) Int. Cl.

| | |
|---|---|
| ***A47G 9/06*** | (2006.01) |
| ***A41D 7/00*** | (2006.01) |
| *A41D 15/00* | (2006.01) |

(58) Field of Classification Search
USPC ..... 34/90; 2/69, 89
See application file for complete search history.

(56) References Cited

U.S. PATENT DOCUMENTS

| | | | | | |
|---|---|---|---|---|---|
| 3,013,274 | A * | 12/1961 | Dike | A41D 7/008 | 2/67 |
| 6,760,921 | B1 * | 7/2004 | Simmons | A41D 3/08 | 2/84 |
| 6,770,581 | B1 * | 8/2004 | DeMott | A47G 23/03 | 428/91 |
| 6,851,127 | B1 * | 2/2005 | Khan | A41D 13/00 | 2/84 |
| 9,332,858 | B1 * | 5/2016 | Chiang | A47C 7/62 | |
| 2005/0044606 | A1 * | 3/2005 | Flanagan-Frazier | A41D 7/006 | 2/69 |
| 2014/0310845 | A1 * | 10/2014 | Holliday | A41D 7/006 | 2/67 |
| 2015/0272294 | A1 * | 10/2015 | Wicker | A47K 10/02 | 34/96 |
| 2016/0007664 | A1 * | 1/2016 | Garriga | A41D 7/008 | 2/69 |
| 2016/0029718 | A1 * | 2/2016 | Darnell | A47G 9/062 | 34/91 |
| 2016/0135518 | A1 * | 5/2016 | Scott | A41D 7/008 | 2/69 |

* cited by examiner

COMBINATION BEACH TOWEL AND COVER-UP

This application claims priority from U.S. Provisional Application 61/780,989, filed Mar. 14, 2013, which is hereby incorporated by reference.

FIELD OF THE DISCLOSURE

The present invention relates to beach towels and more particularly pertains to an improved beach towel that can be readily converted to a stylish swimsuit cover-up.

BACKGROUND

It is now commonplace for women to wear tight fitting one-piece bathing suits and bikinis for purposes of sun bathing and swimming. Unfortunately, swimsuits that are considered quite appropriate for the beach or pool are often considered inappropriate attire away from the beach. Women wishing to leave the beach or pool area for restaurants, shopping establishments, or public streets will usually either change clothes entirely or wear a lightweight outer garment, commonly referred to as a cover-up, over their swimsuits. Carrying a change of clothes or a separate cover-up garment, however, is often inconvenient—especially considering all of the beach or pool necessities that must also be carried, such as beach towels, sunscreen, sunglasses, wallets, books or e-book readers, money, water and sand toys, keys, shoes, an ice chest, snacks, a beach umbrella, radios or digital music players, and cell phones.

It is known to use a modified beach towel as a combination towel and swimsuit cover up. Such combination towels and cover ups have the potential to allow women to have easy access to a cover up whenever they visit the beach or pool. Existing convertible beach towel/cover ups, however, all suffer from significant disadvantages. A number of such known convertible beach towels use straps, ties, or strips of fabric extending from the towel body in order to convert the beach towel to a cover up. Other existing convertible beach towels have integral hoods, use zippers or hook and loop fasteners, or use a towel body having a non-standard (and non-rectangular) shape. These features all tend to increase cost and waste in the manufacturing process, and make the process of converting from a beach towel to a cover up undesirably complicated and time-consuming.

As such, an improved beach towel that can be readily converted into an attractive and comfortable wrap or swimsuit cover-up would be desirable.

SUMMARY OF THE INVENTION

A preferred embodiment of the present invention is directed to a convertible beach towel/cover up that is fashionable and attractive, easy to switch between a beach towel mode and a cover up garment mode, comfortable to wear, and relatively simple and inexpensive to manufacture. It is also an object of the invention to provide a beach towel/cover up garment that is suitable for use by persons of widely varying body sizes.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The present disclosure may be better understood, and its numerous features and advantages made apparent to those skilled in the art by referencing the accompanying drawings.

The accompanying drawings are not intended to be drawn to scale. In the drawings, each identical or nearly identical component that is illustrated in various figures is represented by a like numeral. For purposes of clarity, not every component may be labeled in every drawing.

DETAILED DESCRIPTION OF PREFERRED EMBODIMENTS

Figure 1:
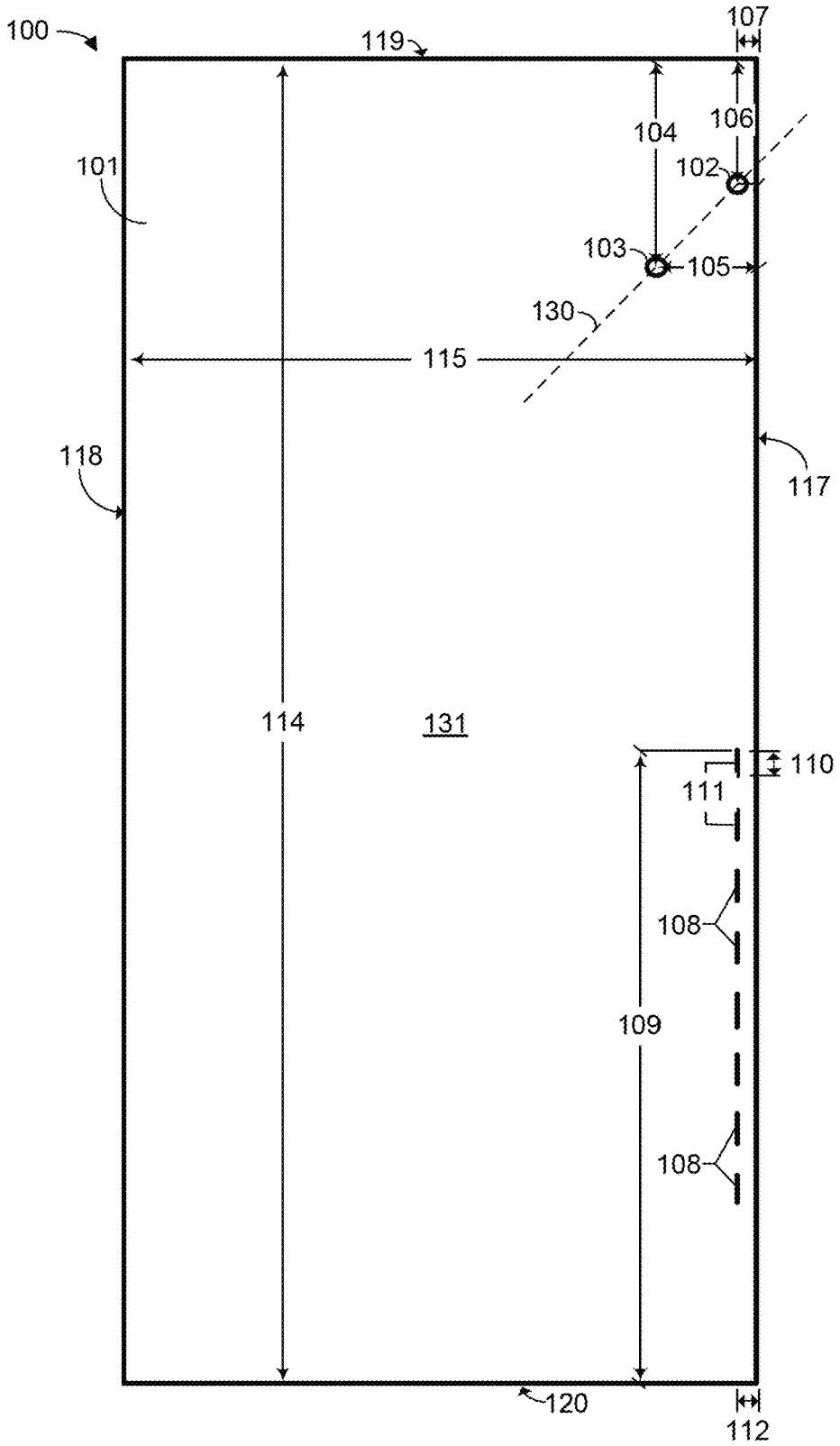
FIG. 1 shows a schematic view of the top side (outside) of a convertible beach towel/cover up according to an embodiment of the invention.

This disclosure, in general, relates to an improved beach towel that can be converted to a swimsuit cover-up, also known as a wrap or a sarong, by simply buttoning the attached two buttons into the buttonholes that are along one length of the towel. In some embodiments, the inventive beach towel has two buttons attached to a face of the beach towel toward a corner of one end of the towel, and also has a series of evenly spaced buttonholes along the same length of the towel at the other end. The spacing between the two buttons matches a spacing of the buttonholes. This allows the wearer of the beach towel/cover up to wrap the towel around their hips, waist, or chest, and secure the buttons into appropriate buttonholes so that the cover up fits the wearer. The cover up can be easily adjusted for different sizes simply by choosing other buttonholes in the series of button holes.

A method or apparatus according to embodiments of the present invention has many novel aspects. Because the invention can be embodied in different methods or apparatuses for different purposes, not every aspect need be present in every embodiment. Moreover, many of the aspects of the described embodiments may be separately patentable. The figures described below are generally schematic and do not necessarily portray the embodiments of the invention in proper proportion or scale unless otherwise stated. Further, although much of the description herein is directed at a towel/cover up for use by female wearers, it should be recognized that embodiments of the invention could also be worn or used by men, not that there is anything wrong with that.

As used herein, the term "beach towel" is used to describe an oversized towel, typically with dimensions of at least about 27 inches by about 60 inches, that can be used as a ground cover on sand, dirt, or concrete, etc., and also as a drying towel after swimming. Embodiments of the invention are not necessarily limited to beach towels, but could be used with any other suitably sized towel, blanket, flexible mat, or fabric sheet, whether intended for use as a beach towel or not. Further, although the description of the invention herein is mainly directed at the use and arrangement of buttons and buttonholes to convert an inventive beach towel into a swimsuit cover up and to secure the cover-up garment, it should be recognized that embodiments of the invention could also be practiced with other fastener types, including but not limited to snaps, hook and eye fasteners, buckles, clasps, clips, latches, ties, closures, or pins.

While convertible beach towel/cover ups are known, existing convertible beach towels typically use straps, ties, or strips of fabric extending from the towel body. Other existing convertible beach towels have integral hoods, use zippers or hook and loop fasteners, or use a towel body having a non-standard (and non-rectangular) shape. These features all tend to increase cost and waste in the manufacturing process, and make the process of converting from a beach towel to a cover up undesirably complicated and time-consuming.

Further, the presence of straps or ties extending from the beach towel body is awkward and in the way when the convertible beach towel/cover up is used as a typical beach towel in the sand or on the ground. Zippers and hook and loop fasteners are easily clogged with sand or dirt, which makes the convertible beach towel useless as a cover up. Such fasteners can also be uncomfortable against a wearer's skin. Other existing convertible beach towels use large head or arm sized slots or openings in the body of the convertible beach towel. These types of large openings compromise the usefulness of the product as a ground cover since the slots or openings will tend to pass sand or dirt from the ground up to the top surface of the beach towel. These openings can also make it difficult to use the product as a drying towel because the openings mean less towel surface area to soak up water from a user's skin.

In particular embodiments of the present invention, however, there are no straps, ties, fabric strips, hoods, or any other features extending from the body of the towel. Further, there are no potentially uncomfortable zippers or hook and loop fasteners and no large slots or openings in the towel body. As a result, a convertible beach towel/cover up according to embodiments described herein can be used as effectively as a typical beach towel to provide a ground cover to protect the user from sand, concrete, dirt, or other surfaces and/or as an absorbent fabric for drying or wiping.

Embodiments of the present invention are also easier and cheaper to manufacture than existing convertible towel/cover ups because of they have a size and rectangular shape that is typical of beach towels manufactured all over the world. By using standard rectangular towel shapes, there is also less wasted towel material during manufacturing. The manufacturing process is thus simplified because the towel body can be produced using standard towel manufacturing techniques. Finishing the product simply requires attaching buttons or other fasteners and creating a row of standard buttonholes at evenly spaced locations as described below.

Figure 2:
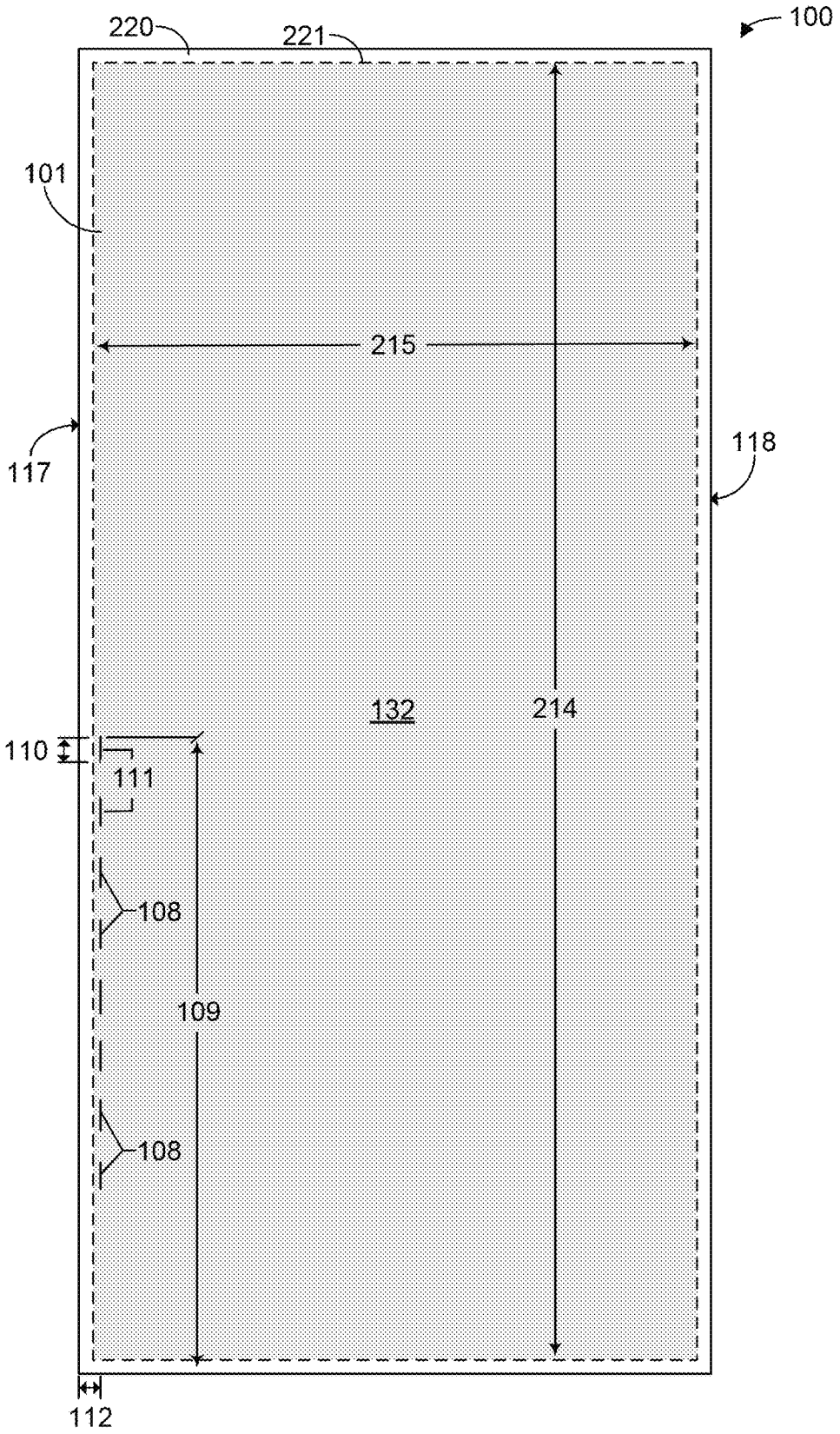
FIG. 2 shows a schematic view of the reverse or bottom side (inside) of a convertible beach towel/cover up according to an embodiment of the invention.

FIG. 1 shows a schematic view of the top side (outside) of a convertible beach towel/cover up according to an embodiment of the invention. FIG. 2 shows a schematic view of the reverse or bottom side (inside) of a convertible beach towel/cover up according to an embodiment of the invention. Towel body 101 can be generally rectangular in shape, having a top edge 117, a bottom edge 118, a left edge 119, and a right edge 120. As used herein, the top and bottom edges are defined by the top and bottom portions of the towel body when worn as a cover up, with the top edge being the upper edge of the cover up which is at the wearer's hips or chest, depending on whether the cover up is worn as a skirt or a dress, and the bottom portion being the lower edge that is toward the wearer's legs. The right and left edges are defined when looking at the towel from the perspective shown in FIG. 3A with the outer surface of the towel body (the surface with the attached buttons that will be on the outside of the garment when the convertible beach towel is worn as a cover up).

In the embodiment of FIG. 1, the towel body has a length 114 of about 127 cm to about 203 cm, such as about 140 cm to 178 cm, or about 150 cm to about 155 cm, or about 153 cm. The towel body has a width 115 of about 60 cm to about 90 cm, such as about 70 cm to 80 cm, or about 73 cm. In other embodiments, towel body 101 may be formed in any suitable shape and size as long as the functionality described herein is maintained. Although other sizes and/or shapes could be used, the embodiment of FIG. 1 makes use of a standard beach towel size and shape for easier and less expensive manufacturing.

Towel body 101 can comprise a flexible and absorbent fabric such as terry cloth or a woven linen cotton blend. Other suitable fabric or textile materials could be used, although in most cases it would be preferable to use a material that has a good moisture absorbing ability, while still providing protection from sun and wind when worn as a cover up. In some embodiments, towel body 101 comprises a fabric that is 100% cotton. In some embodiments, towel body 101 comprises a fabric that is made of a cotton-blend fiber such as a blend of 80% cotton and 20% polyester. Towel body 101 can also comprise a layer of a super-absorbent material such as a microfiber or a super-absorbent polymer.

In some embodiments, the entire towel body can be made from the same fabric. Referring also to FIG. 2, in other embodiments, the towel body can be formed with multiple fabric layers so that one side of the towel body 131 is made of a first material, while the other side of the towel body 132 is made of a second material. In some instances, one or more interior layers could also be used, such as an interior layer of a super-absorbent material. When multiple fabric layers are used, the layers can be joined using any suitable method including stitching the layers together to form a seam 220 along their outermost edges.

In some embodiments, the weight of the towel body fabric can be selected so as to optimize comfort and softness while still being light-weight enough to worn in a hot, sunny environment. As would be recognized by person of skill in the relevant art, the standard measurement for weight and quality of fabrics is grams per square meter, usually abbreviated as GSM. This number reflects the density of the fabric, and fabrics with higher weights will typically be heavier, more absorbent, and have a more luxurious feel. A typical quality beach towel will have a weight of 450-500 GSM, while lower quality towels may only have weights of 280-350 GSM.

Applicant has discovered, however, that by using a combination of a 100% cotton cut loop velour on the outer layer and a looped terry cloth on the inner layer in some particular embodiments of the invention, that the towel body fabric still has a soft and luxurious feel at a weight of no more than about 400 GSM. In some embodiments, more yarn can be used on the top velour side than on the bottom terry cloth side. As a result, even using an overall weight of only 400 GSM, the fabric will have more weight and feel softer to the touch on the top (or outside) surface of the towel body, while still maintaining an overall lightweight feel. In some embodiments, the top velour side might have up to 50% more yarn than the bottom terry cloth side, such as up to 25% more yarn, 15% more yarn, 10% more yarn, 5% more yarn, 2% more yarn, or 1% more yarn. Intentionally using a lower weight fabric in a high-quality product intended to have a luxurious look and feel runs counter to conventional wisdom in the field, which considers 450 GSM as the lower limit for a quality beach towel fabric. Applicant has also discovered that using the lower weight fabric used in particular embodiments results in a number of advantages. Not only is the lower weight fabric less expensive, its lighter weight makes it easier to carry and wear. The lower weight fabric is also thinner and more comfortable to wear in hot sunny weather, and it dries considerably faster than heavier weight fabrics.

Referring again to FIG. 1, the convertible beach towel/cover up according to embodiments of the present invention makes use of a unique arrangement of buttons and buttonholes to allow a beach towel to be quickly and easily converted to a wearable swimsuit cover up. In the embodiment of FIG. 1, two large buttons 102, 103 are positioned toward the top left corner of the upper side of the towel body 101. In particular embodiments, the buttons are position about 5 to 15 cm apart, such as about 5 to 10 cm apart, or about 6 to 8 cm apart, or about 7 cm apart. As used herein, all measurements are from the center of the button or other feature unless otherwise stated.

Significantly, in some embodiments the buttons are positioned diagonally with respect to the towel edges. In FIG. 1, the upper button 102 is positioned about 1 to 5 cm from the top edge 117 of the towel body 101, such as about 3 to 4 cm from the top edge, or about 2.5 cm from the top edge, and about 10 to 20 cm from the left edge 119 of the towel body, such as about 12 to 17 cm from the left edge, or about 14.5 cm from the left edge. The lower button 103 is positioned about 5 to 20 cm from the top edge 117 of the towel body 101, such as about 10 to 15 cm from the top edge, or about 12 cm from the top edge, and about 15 to 35 cm from the left edge 119 of the towel body 101, such as about 20 to 30 cm from the left edge, or about 24 cm from the left edge. In the embodiment of FIG. 1, the buttons 102, 103 are positioned on diagonal line 130. According to some embodiments, buttons can be positioned back to back at substantially the same location on either side of the towel body so that the towel and cover up would be reversible.

A series of buttonholes 108 are formed along the top edge 117 of the towel body 101 at a distance 112 from the top edge 117 that is approximately equal to the distance 107 between the top edge 117 and top button 102. In the embodiment of FIG. 1, eight separate buttonholes 108 are formed along a line that is approximately 2.5 cm below the top edge 117 of the towel body and parallel to that top edge. In the embodiment of FIG. 1, the first buttonhole (closest to the buttons) starts at a distance 109 of about 73 cm from the right side of the towel body. The row of buttonholes then extends toward the right edge of the towel body, with each buttonhole 108 being about 2.5 cm wide and spaced at a distance 111 of about 7 cm on center from the adjacent buttonholes. Any suitable sizes and spacings could be employed, but a person of skill in the art will appreciate that the size of the buttonhole should approximate the size of the buttons used.

In order to convert the beach towel into a swimsuit cover up, a wearer simply wraps the towel around their hips (or chest) with the top side (outside) of the towel body facing away from the wearer's body. The button side of the towel will wrap around the wearer's hip coming from the wearer's left side. The buttonhole side of the towel will wrap around from the right side. After wrapping the cover up snugly around the wearer's hips (or chest) the buttons can be fitted through the appropriate buttonholes to secure the cover up in place. The relatively large number of buttonholes in the embodiment of FIG. 1 allows the same cover up to fit a wide range of waist (or chest) sizes.

Embodiments with any desired number of buttonholes could be used although the closer a buttonhole is to the buttons 102, 103, the smaller a wearer's waist size would have to be in order to use that buttonhole. Likewise, in some embodiments the line of buttonholes could extend closer to the right edge of the towel body, but the further away a buttonhole is from buttons 102, 103, the larger a wearer's waist size would have to be in order to wear the cover up when using that buttonhole. The buttonhole placement in FIG. 1 will accommodate waist (or chest) sizes from 24 inches to 38 inches, which will accommodate the vast majority of the swimsuit wearing public.

Figure 3A:
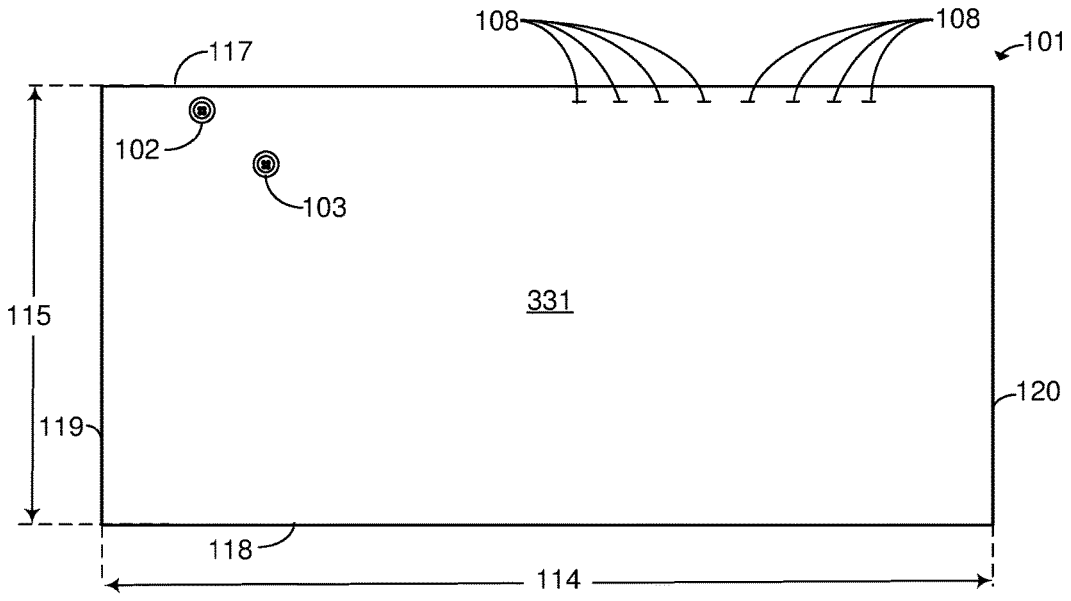
FIG. 3A shows the top side (outside) of a convertible beach towel/cover up according to an embodiment of the invention.
Figure 3B:
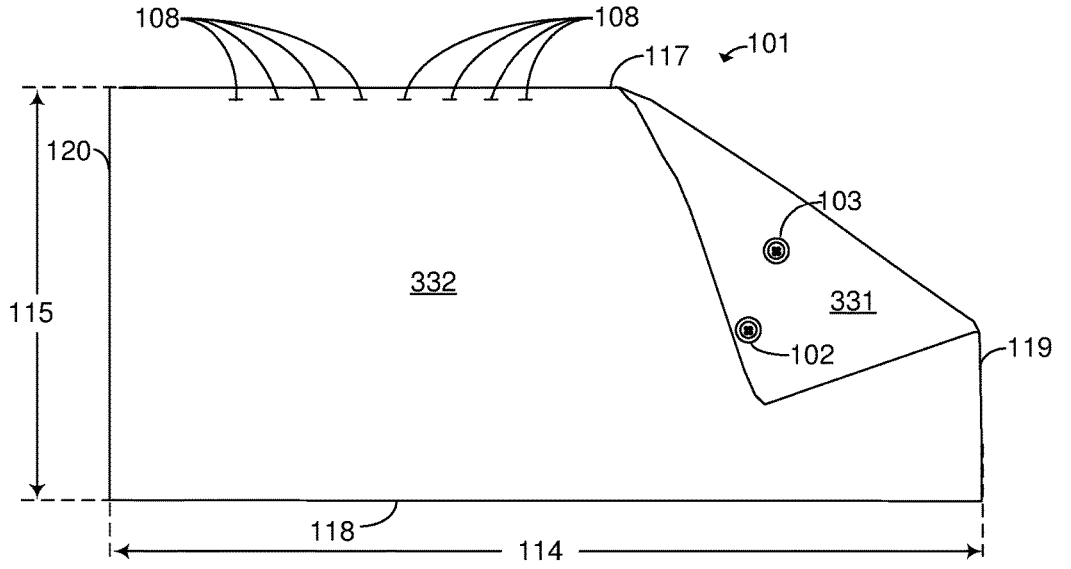
FIG. 3B shows the bottom side (inside) of the convertible beach towel/cover up of FIG. 3A.

FIG. 3A shows the top side (outside) of a convertible beach towel/cover up according to an embodiment of the invention. As seen in FIG. 3A, the fabric on the top side (outside) has an aesthetically pleasing pattern formed on the top side fabric. FIG. 3B shows the bottom side (inside) of the convertible beach towel/cover up of FIG. 3A. The bottom side fabric 332 is also patterned, but with a different pattern than top side fabric 331. In other embodiments, the top side and bottom side could have the same pattern or no pattern.

Figure 4:
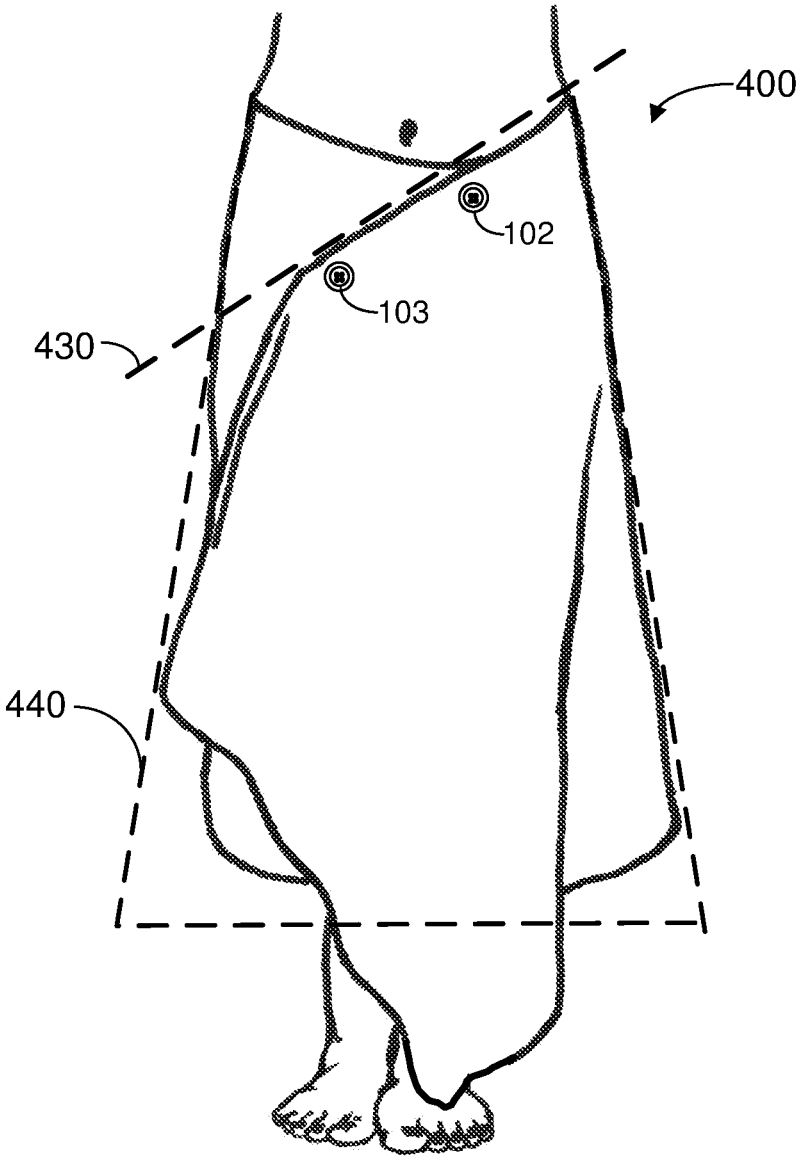
FIG. 4 shows a front view of a convertible beach towel/cover up according to an embodiment of the invention that is being worn on the wearer's hips.
Figure 5:
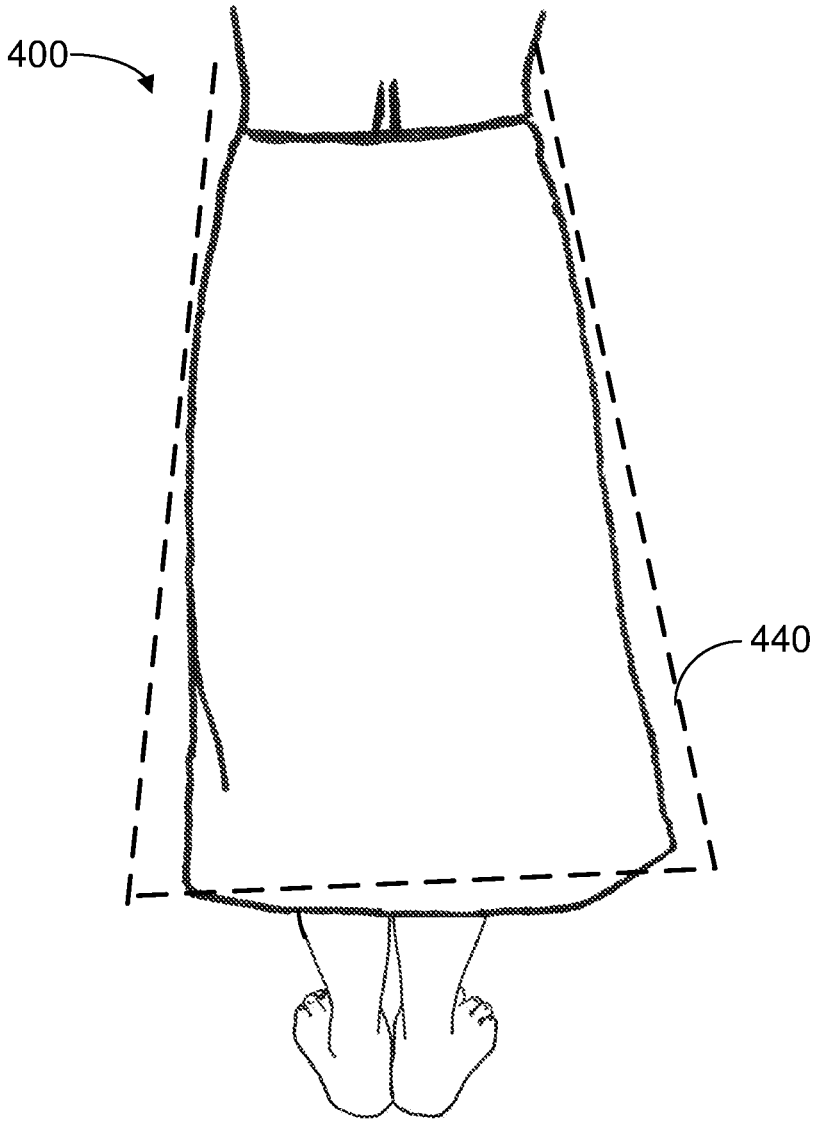
FIG. 5 shows a rear view of the convertible beach towel/cover up of FIG. 4.
Figure 6:
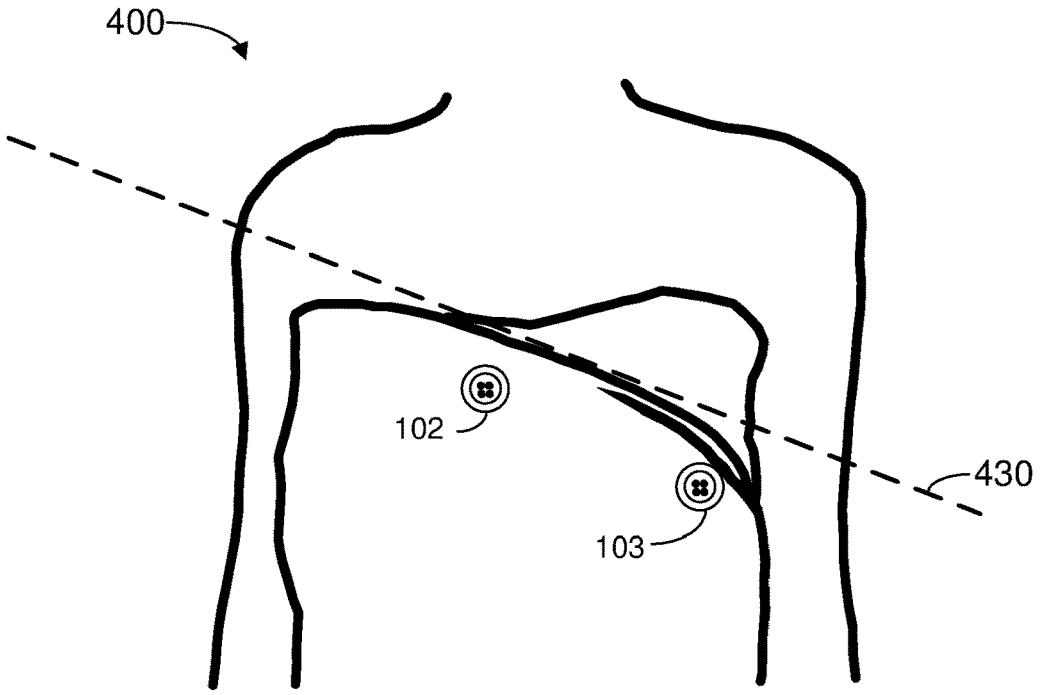
FIG. 6 shows a front view of a convertible beach towel/cover up according to an embodiment of the invention that is being worn around the wearer's chest.
Figure 7:
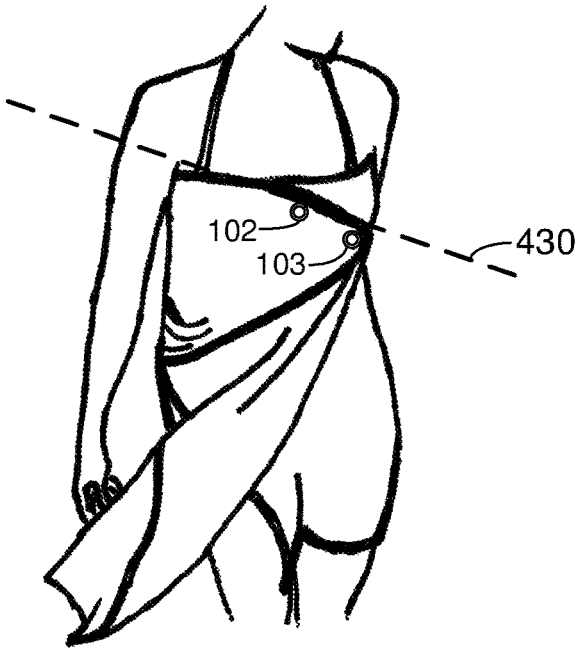
FIG. 7 shows an angled view of the convertible beach towel/cover up of FIG. 6.

FIG. 4 shows a front view of a convertible beach towel/cover up according to an embodiment of the invention that is being worn on the wearer's hips as a skirt. FIG. 5 shows a rear view of the convertible beach towel/cover up of FIG. 4. FIG. 6 shows a front view of a convertible beach towel/cover up according to an embodiment of the invention that is being worn around the wearer's chest as a dress. FIG. 7 shows an angled view of the convertible beach towel/cover up of FIG. 6.

As described above, in the embodiments shown in FIGS. 4-7, the buttons used to fasten the converted cover up garment around a wearer's waist or chest are positioned on a diagonal line with respect to the towel edges. As illustrated in FIG. 4, this diagonal arrangement of the buttons results in the upper edge of the wrapped cover up on the right or buttonhole side being secured at an angle with respect to the wrapped left or button side. This angle is shown by dashed line 430, which largely corresponds to the angle at which the buttons are positioned. As also shown in FIG. 4, this angled portion of the wrapped cover up forms a flattering V-shape on the wearer. In particular embodiments of the invention, the two buttons define a line that is at an acute angle with the top edge of the towel body (when the towel body is fully unfolded as shown in FIG. 1). In other embodiments, the two buttons define a line that is at an angle of at least about 30° to about 60° with respect to the top edge of the towel body, such as an angle of at least about 40° to about 50°, or such as at an angle of at least about 45°.

Further, angling the upper edge of the cover up causes the bottom edge of the towel (the lower portion of the skirt formed by the cover up in FIG. 4) to flare out. As a result, the cover up, whether worn around the hips as a skirt or around the chest as a dress, forms a desirable and fashionable A-line shape, as shown by the dashed lines 440, that is fitted at the top edge and gradually widens towards the bottom edge. Not only does this give the cover up garment a stylish and attractive appearance, but it also causes the beach towel/cover up to flare away from the wearer's body. Thus, even if a wearer is wet from swimming or cooling off in the ocean, lake, or pool, the cover up fabric will not cling to the wearer's skin, which is not only a more attractive look but also makes wearing the cover up much more comfortable than if the fabric were sticking to the wearer's legs with every step.

According to another embodiment of the present invention, a rectangular piece of fabric can be used to form a sarong using features and methods described herein. Instead of a cotton beach towel, the rectangular fabric could comprise rayon, silk, satin, or Egyptian cotton. Traditional sarongs require the fabric to be tied around the wearer using a variety of methods. It can be difficult to learn how to tie the sarong so that it forms a flattering style and so that it stays in place. Additionally, the knots themselves can create unwanted bulk on the body. While there are sarong clips on the market that allow the user to clip the sarong together to secure it in place and avoid large and cumbersome fabric knots, such clips are an additional expense and a wearer must be able to locate an appropriate clip in order to wear the sarong. Particular embodiments of this invention eliminate the need for both the traditional knots and the clips by using the simple and unique arrangement of buttons and buttonholes described herein to secure the sarong in place.

The invention has broad applicability and can provide many benefits as described and shown in the examples above. The embodiments will vary greatly depending upon the specific application, and not every embodiment will provide all of the benefits and meet all of the objectives that are achievable by the invention. Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention. After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present). Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

Although the present invention and its advantages have been described in detail, it should be understood that various changes, substitutions and alterations can be made to the embodiments described herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A combination beach towel and swimsuit cover up comprising:

a substantially rectangular towel body, wherein the towel body has a top edge, a bottom edge, a left edge, and a right edge and has a first face and a second face;

a plurality of buttons positioned in a top left corner of the towel body;

a plurality of buttonholes arranged in a row along the top edge of the towel body and substantially parallel to the top edge of the towel body, the buttonholes positioned so that when the towel body is wrapped around a wearer's body, each of the plurality of buttons can be inserted into a button hole to secure the towel body in place;

wherein the buttons are arranged along a line that is at an angle of about 30 degrees to about 60 degrees with respect to the top edge of the towel body so that when the buttons are inserted into the buttonholes the portion of the wrapped towel body in which the buttonholes are formed is secured at an angle of at least 30 degrees with respect to the top edge of the towel body.

2. The combination beach towel and swimsuit cover up of claim 1 in which securing the button and buttonholes together causes the wrapped towel body to be closely fitted around the wearer's body at the top edge of the towel body but the gradually widen toward the bottom edge.

3. The combination beach towel and swimsuit cover up of claim 1 in which the towel body can be formed into a swimsuit cover up by wrapping the towel around a wearer's body along the long axis of the towel body so that the buttons can be inserted into buttonholes to hold the wrapped towel body around the hips or chest of the wearer.

4. The combination beach towel and swimsuit cover up of claim 1 in which the plurality of buttons comprises two buttons, a first button attached to the first face of the towel body at a distance of about 1 cm to about 5 cm from the top edge of the towel body and about 10 cm to about 20 cm from the left edge of the towel body and a second button attached to the first face of the towel body at a distance of about 5 to about 20 cm from the top edge of the towel body and about 15 to about 35 cm from the left edge of the towel body.

5. The combination beach towel and swimsuit cover up of claim 1 in which the towel body can be used as a swimsuit cover up by wrapping the towel body around the body of a swimsuit wearer along the long axis of the towel body so that the plurality of buttons positioned in a top left corner of the towel body can be inserted into buttonholes arranged in a row along the top edge of the towel body to secure the towel body in position around the swimsuit wearer's body; and in which wrapping the towel body around the body of a swimsuit wearer so that the plurality of buttons positioned in a top left corner of the towel body can be inserted into buttonholes arranged in a row along the top edge of the towel body causes the top edge of the portion of the wrapped towel body in which the buttonholes are formed to be angled down with respect to the top edge of a remaining portion of the towel body at an angle of about 30 degrees to about 60 degrees.

6. The combination beach towel and swimsuit cover up of claim 5 in which the angled orientation of the top edge of the portion of the wrapped towel body in which the buttonholes are formed with respect to the top edge of the remaining portion of the towel body causes the wrapped towel body to form a flared shape that gradually widens from the top edge of the towel body toward the bottom edge of the towel body.

7. The combination beach towel and swimsuit cover up of claim 1 in which the towel body comprises a top layer of 100% cotton cut loop velour and a bottom layer of 100% cotton terry cloth.

8. The combination beach towel and swimsuit cover up of claim 1 in which the towel body comprises a fabric having a weight of no more than about 400 GSM.

9. The combination beach towel and swimsuit cover up of claim 1 in which the towel body comprises a top layer of 100% cotton cut loop velour and a bottom layer of 100% cotton terry cloth and in which the top layer comprises as much as 50% more yarn than the bottom layer.

10. The combination beach towel and swimsuit cover up of claim 1 in which the towel body can be wrapped around the body of a swimsuit wearer at the hips to form a skirt cover up or wrapped around the body of a swimsuit wearer at the chest to form a dress cover up.

11. A combination towel and cover up comprising:

a substantially rectangular towel body, wherein the towel body has a top edge, a bottom edge, a left edge, and a right edge and has a first face and a second face;

a plurality of first fastener components positioned in a top left corner of the towel body;

a plurality of corresponding second fastener components arranged in a row along the top edge of the towel body and substantially parallel to the top edge of the towel body, the second fastener components positioned so that when the towel body is wrapped around a wearer's body, a plurality of first fastener components can be connected to corresponding second fastener components to secure the towel body in place;

wherein the first fastener components are arranged along a line that is at an angle of about 30 degrees to about 60 degrees with respect to the top edge of the towel body so that when the first and second fastener components are connected the portion of the wrapped towel body to which the second fastener components are formed is secured at an angle of at least 30 degrees with respect to the top edge of the towel body.

12. The combination towel and cover up of claim 11 in which the first fastener components and corresponding second fastener components comprise buttons and buttonholes, snap fasteners, or hook and eye fasteners.

13. The combination towel and cover up of claim 11 in which the towel body can be used as a cover up by wrapping the towel body around the body of a swimsuit wearer along the long axis of the towel body so that, when the first and second fastener components are connected, the top edge of the portion of the wrapped towel body on which the second fastener components are arranged is angled down with respect to the top edge of a remaining portion of the towel body at an angle of about 30 degrees to about 60 degrees.

14. The combination towel and cover up of claim 11 in which securing the first and second fastener components together causes the wrapped towel body to be closely fitted around the wearer's body at the top edge of the towel body but the gradually widen toward the bottom edge.

15. The combination towel and cover up of claim 11 in which the towel body comprises a top layer of 100% cotton cut loop velour and a bottom layer of 100% cotton terry cloth.

16. The combination towel and cover up of claim 11 in which the towel body comprises a fabric having a weight of no more than about 400 GSM.

17. The combination towel and cover up of claim 11 in which the towel body comprises a top layer of 100% cotton cut loop velour and a bottom layer of 100% cotton terry cloth and in which the top layer comprises as much as 50% more yarn than the bottom layer.

18. The combination towel and cover up of claim 11 in which the towel body can be wrapped around the body of a swimsuit wearer at the hips to form a skirt cover up or wrapped around the body of a swimsuit wearer at the chest to form a dress cover up.

* * * * *